US005674018A

United States Patent [19]

Kaufman et al.

[11] Patent Number: 5,674,018

[45] Date of Patent: Oct. 7, 1997

[54] WEATHERPROOF ELECTRONIC KEYPAD WITH REPLACEABLE GRAPHICS OVERLAY

[75] Inventors: Peter Kaufman; John C. Echols; Henry Miszkiewicz, all of Santa Barbara, Calif.

[73] Assignee: Essex Electronics, Inc., Carpinteria, Calif.

[21] Appl. No.: 363,296

[22] Filed: Dec. 23, 1994

[51] Int. Cl.[6] ..... B41J 5/12

[52] U.S. Cl. ..... 400/473; 400/490; 200/512; 200/513

[58] Field of Search ..... 200/512, 513, 200/514, 515, 516; 400/472, 473, 477, 490, 493, 496

[56] References Cited

U.S. PATENT DOCUMENTS

| | | | |
|---|---|---|---|
| 4,673,108 | 6/1987 | De Man | 200/512 |
| 5,138,119 | 8/1992 | Demeo | 200/512 |
| 5,357,065 | 10/1994 | Mitamura et al. | 200/513 |
| 5,430,263 | 7/1995 | English et al. | 200/512 |
| 5,489,754 | 2/1996 | Dirmeyer et al. | 200/512 |
| 5,510,586 | 4/1996 | Arnal | 200/516 |
| 5,512,721 | 4/1996 | Young et al. | 200/512 |

*Primary Examiner*—John S. Hilten

*Attorney, Agent, or Firm*—Learman & McCulloch

[57] ABSTRACT

A weatherproof electronic keypad includes a molded plastic housing, a plurality of transducers attached to the inside surface of the front wall of the housing, an electronic circuit mounted within the housing and connected to the transducers, and a graphics overlay removably affixed to the outside surface of the front wall of the housing. The front wall and overlay are sufficiently flexible that finger pressure applied to the overlay results in enough deformation of the front wall to activate the transducer underlying that portion of the inside surface. The overlay contains indicia which identify the location and function of the transducers. The overlay need not be attached to the housing as a part of manufacturing the keypad, but rather can be added in situ as part of installation of the keypad. This enables customized selection of a particular overlay in accordance with aesthetic and/or functional considerations, as well as replacement of the overlay in the field if necessary.

8 Claims, 2 Drawing Sheets

WEATHERPROOF ELECTRONIC KEYPAD WITH REPLACEABLE GRAPHICS OVERLAY

This invention relates to electronic keypads in general and more particularly to weatherproof and vandal resistant keypads that permit customization and in situ replacement of the graphics used for the keypad indicia.

BACKGROUND OF THE INVENTION

Weatherproof keypads are used in outdoor and other environmentally demanding applications. These keypads typically are made weatherproof by providing a sealed housing having a flexible keypad surface under which membrane switches or transducers are located. For example, in one known construction the keypad housing, including the keypad surface, is formed in its entirety from stainless steel stamped or drawn into the desired shape. The housing includes a front wall and four unitary sidewalls that give the housing a rectangular shape. The rear side of the housing is open and is used to provide access to the interior of the housing for assembly of the keypad components into the housing. Transducers, such as piezoelectric wafers and benders, are adhered to the inside surface of the front wall. A printed circuit board containing the electronics needed to detect activation of any of the transducers is mounted in the housing behind the transducers. The assembly is then sealed to prevent the ingress of moisture by means of a rigid potting material that is poured over the backside of the circuit board up to a level flush with the rear edges of the housing's side walls. The outside surface of the front wall of the housing contains indicia, such as numerals, that are permanently applied to the surface of the front wall, such as by silk-screening, prior to assembly of the keypad housing and components.

One problem that exists with this type of weatherproof keypad is that the front wall of the keypad sometimes is subject to intentional or accidental cosmetic damage that mars or obscures the indicia printed thereon. In these circumstances, replacement of the front wall is desirable and may even be necessary, as in the case of complete obliteration of the indicia. However, since the front plate is an integral part of the housing replacement of the front wall alone is not possible, thereby requiring replacement of the entire keypad assembly, typically by trained personnel.

SUMMARY OF THE INVENTION

An electronic keypad according to the invention comprises a plastic housing that includes a generally planar front wall having an outside surface and an inside surface, two or more transducers secured to the inside surface of the front wall, an overlay covering at least a portion. of the outside surface of the front wall, and an electronic circuit electrically coupled to each of the transducers. The overlay is removable to permit its replacement. The overlay contains indicia each of which is associated with one of the transducers and located on the overlay opposite its associated transducer to identify the location of the transducer. The overlay and the front wall together have sufficient flexibility that the inside surface of the front wall is deformable upon application of finger pressure to the overlay.

Each of the transducers is deformable in response to localized deformation of the inside surface that results from the application of finger pressure to the overlay at a location opposite the transducer, and each of the transducers has a characteristic that undergoes a measurable change in response to the localized deformation of the inside surface. Thus, finger pressure can be applied to any one of the indicia on the overlay to cause a measurable change in characteristic of the transducer associated with the selected one of the indicia. The electronic circuit is operable in response to detecting this measurable change in characteristic to generate an output that indicates the activation of the selected transducer.

Preferably, the housing comprises a unitary molded plastic structure that includes the front wall and four side walls that extend perpendicularly to the plane of the front wall, thereby leaving the rear side of the housing open for installation of the keypad components. The transducers can be of any suitable kind, such as piezoelectric elements or force sensitive resistors, that are adhered to the inside surface of the front wall.

The electronic circuit can be carried by a printed circuit board that is mounted within the housing behind the transducers. A soft potting fills the space between the transducers and printed circuit board. A relatively rigid potting fills the space between the printed circuit board and the rear opening. This rigid potting provides a weatherproof seal of the components within the keypad and provides structural integrity for the keypad.

The overlay can be a flexible layer of stainless steel or other durable material. It can also comprise a layer of translucent plastic having the indicia attached or printed on its backside. A light source can be positioned within the housing so as to illuminate the indicia. The light source can be mounted slightly above the plane of the overlay and oriented to flood the surface of the overlay and illuminate the indicia. In the case of a translucent plastic overlay, the light source can be oriented so as to edge light the overlay by transmitting light through the translucent overlay in a direction parallel to the surface of the overlay.

The overlay is removably attached to the front wall, either as a part of the manufacture of the keypad or as a part of final installation of the keypad at a particular site. Preferably, the overlay is attached using an adhesive applied to the backside of the overlay. The electronic circuit can be implemented using a printed circuit board mounted within the housing in spaced relation to the front wall.

An advantage of a keypad constructed in accordance with the invention is that not only is it suitable for environmentally demanding applications, but it also can be provided with any one of a number of graphic overlays to permit customization of the appearance of the keypad surface and indicia. The keypad can be manufactured without an overlay and the overlay can be applied in the field at the time of installation of the keypad. Additionally, the overlay can be removed and replaced if necessary or desirable, without requiring replacement of the keypad or access to its contents and without the need for trained personnel.

BRIEF DESCRIPTION OF THE DRAWINGS

The presently preferred embodiment of the invention is illustrated in the accompanying drawings wherein.

DESCRIPTION OF THE PREFERRED EMBODIMENT

Figure 1:
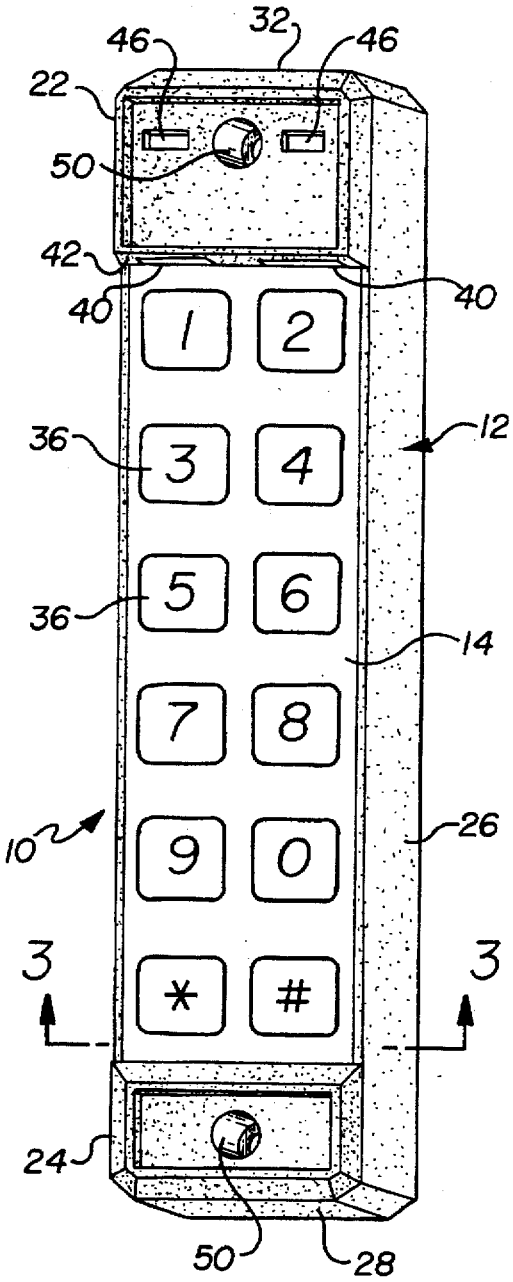
FIG. 1 is a front perspective view of the electronic keypad.

An electronic keypad according to the invention is designated generally by the reference character 10 and includes a housing 12, an overlay 14, a plurality of transducers 16, and an electronic circuit embodied in a printed circuit board 18 having appropriate electronic components (not shown) soldered thereto. Overlay 14 is adhered to the outside surface 20*a* of a front wall 20 of housing 12 and transducers 16 are adhered to the inside surface 20*b* of front wall 20. Circuit board 18 is mounted within housing 12 spaced from and parallel to front wall 20. Transducers 16 and circuit board 18 are encapsulated within housing 12 by filling housing 12 with potting, as will be described below.

Figure 3:
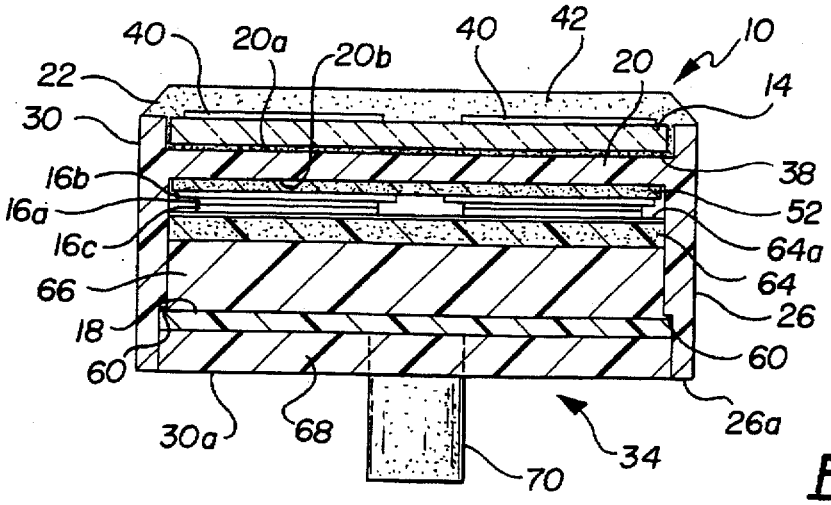
FIG. 3 is an enlarged cross-sectional view taken along the 3—3 line of FIG. 1 and showing the various layers and components within the keypad.

Front wall 20 of housing 12 is recessed from upper and lower sections 22, 24, which are used for mounting keypad 10 to a structure and for providing illumination and status display, as will be described below. Housing 12 also includes four side walls 26, 28, 30, and 32 that are joined at beveled corners and are unitary with front wall 20 and upper and lower sections 22, 24. As best shown in FIG. 3, front wall 20 and side walls 26 and 30 of housing 12 together have a U-shaped cross section that forms an inner region of housing 12 and a rear opening 34 between the rearward extents 26*a* and 30*a* of side walls 26 and 30, respectively.

Overlay 14 is a thin sheet having indicia such as numerals 36 and/or other symbols to indicate the location and function associated with each of the transducers 16 located within housing 12. Overlay 14 is sufficiently flexible that it provides much less resistance to deformation than does front wall 20. As can be understood by comparison of FIGS. 1 and 2, each of the numerals 36 on overlay 14 is associated with a contralateral transducer 16 on front wall 20 within the inner region of housing 12. Overlay 14 can be attached to outside surface 20*a* of front wall 20 using an adhesive 38 that is applied to the backside of overlay 14 as a part of the manufacture of overlay 14. A pressure sensitive transfer adhesive can be used, such as Isotac Y-9469, manufactured by 3M. As is known, release paper can be used to protect adhesive 38 until assembly of overlay 14 with front wall 20.

In accordance with one feature of the invention, overlay 14 can be formed from any one of a number of different materials so that it can conform to aesthetic and/or functional requirements. This also permits customization of keypad 10 in the field at the time of installation. Additionally, replacement of a damaged overlay does not necessitate replacement of the entire keypad, but only the overlay itself, which does not require highly trained personnel. Exemplary overlays include brass and stainless steel with indicia printed thereon, translucent plastic (e.g., Lexan™), with the indicia printed on the rear surface of the overlay so that the indicia are viewable through the translucent plastic.

Upper and lower sections 22, 24 of housing 12 protrude forward of overlay 14 by a small distance. This enables upper section 22 to have a pair of slots or openings 40 on its underside 42 through which light can be transmitted to illuminate the indicia 36 on overlay 14. The light can be provided by green LEDs 44 (shown in phantom) that are mounted on circuit board 18 and oriented downwardly to illuminate the surface of overlay 14.

In the case of overlay 14 being a translucent material, LEDs 44 can be used to provide edge lighting that is transmitted through the translucent material. Upper section 22 can also include a second pair of openings 46 on its front side to permit viewing of conventional, colored status LEDs 48 (shown in phantom), which are also mounted on circuit board 18. Openings 40 and 46 can be covered by a transparent window to prevent moisture from entering housing 12. Upper and lower sections each include a counter sunk mounting hole 50 into which a screw can be inserted for mounting of keypad 10. These mounting holes can be covered by a plastic plate (not shown) that can also include the windows for openings 46.

Transducers 16 are adhered or otherwise bonded to inside surface 20*b* of front wall 20 in such manner as to enable each transducer to be deformed in response to localized deformation of front wall 20 resulting from finger pressure applied to overlay 14 at a location opposite any related transducer. For example, a known, double-sided adhesive acrylic foam tape 52, manufactured by 3M, can be used to adhere transducers 16 to inside surface 20*b*.

As will be appreciated by those skilled in the art, pressure applied to overlay 14 causes slight deformation of both overlay 14 and front wall This deformation is carried through to inside surface 20*b*. The amount of deformation of inside surface 20*b* depends upon the pressure applied during a typical finger press and the flexibility of overlay 14 and front wall 20. As is well known, the flexibility of these elements depends upon such factors as their thickness and the materials out of which they are made. Preferably, housing 12 is made as a unitary structure from Valox 310SEO, manufactured by General Electric, and front wall 20 has a thickness of 0.060 inch.

Transducers 16 are selected in accordance with the amount of localized deformation of inside surface 20*b* so that transducers 16 will undergo a measurable change in characteristic in response to that localized deformation. The deformation of inside surface 20*b* that causes this measurable change in characteristic can either be by compression or bending deformation of the transducer. Transducers 16 can be of any suitable type, such as a piezoelectric or a force sensitive resistor. For example, each transducer 16 can be a Murata Erie 7BB-15-5-1 piezoelectric bender, which has a piezoelectric wafer 16*a* sandwiched between a pair of electrodes 16*b*, 16*c*. In the case of piezoelectrics, deformation of the transducers results in a voltage being developed between electrodes 16*b* and 16*c*. This voltage can be detected by either of the circuits shown in FIGS. 4 and 5, as will be discussed below. In the case of a force sensitive resistor (or other strain gauge), deformation results in a change in resistance between terminals of the force sensitive resistor that can be detected by a circuit similar to that in FIGS. 4 and 5, as will also be discussed below.

Figure 2:
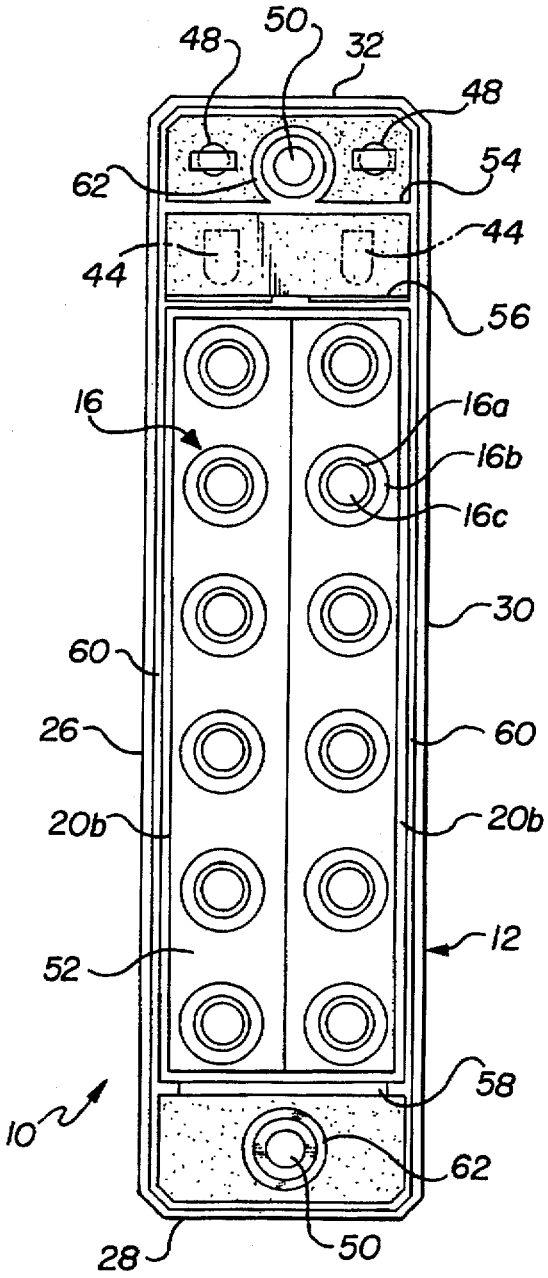
FIG. 2 is a rear view of the inside of keypad of FIG. 1 showing the transducers attached to the inside surface of the keypad's front wall.

As shown in FIG. 2, housing 12 includes a first transverse inner wall 54 within upper section 22, a second transverse inner wall 56 separating front wall 20 from upper section 22, and a third transverse inner wall 58 separating front wall 20 from lower section 24. Housing 12 also includes a ledge 60 extending along side walls 26, 28, 30, and 32, as well as a circular shoulder 62 at each of the mounting holes 50. Inner walls 54, 56, and 58, ledge 60, and shoulders 62 all extend partway towards rear opening 34 by the same distance and provide support for circuit board 18. Thus, circuit board 18 extends the entire length of keypad 10 and completely covers transducers 16 and the other components located in the compartments defined by inner walls 54, 56, and 58.

As shown in FIG. 3, a known foam backing 64 having an adhesive layer 64*a* is placed over piezoelectric transducers 16. A soft, known potting material 66 is then poured over foam backing 64 up to the level of ledge 60. Circuit board 8 is then seated on its supports with the circuit components (not shown) facing towards front wall 20 so that they are encapsulated by potting 66. Thus, foam backing 64 and potting 66 fill the portion of the inner region of housing 12 between transducers 16 and circuit board 18. A relatively rigid potting material 68 is then poured over the backside of circuit board 18 to fill the portion of the inner region between circuit board 18 and rear opening 34. Circuit board 18 is dimensioned to fit tightly between walls 26 and 30 to help prevent the rigid potting material from flowing around the edges of circuit board 18 and toward transducers 16.

Foam backing 64 is used to provide cushioning between transducers 16 and potting 66 and to keep potting 66 from bonding to transducers 16 so that thermal expansion or contraction of potting 66 will neither activate transducers 16 nor pull them loose from their adhesion to front wall 20.

Potting 66 is selected to be relatively flexible so that if the potting does flow around foam backing 64 and comes into contact with piezoelectric transducers 16, it will not restrict the bending deformation of those transducers needed to generated a measurable voltage across their electrodes.

In the case of transducers 16 being force sensitive resistors or other transducers that rely primarily upon compressive deformation for their activation, foam backing 64 is not needed and instead a relatively rigid support for transducers 16 would be used. A coating of potting 66 can also be applied over the backside of circuit board 18 to prevent the rigid potting 68 from bonding to circuit board 18, which could otherwise result in potting 68 separating the electrical traces of circuit board 18 from their substrate under the forces of thermal expansion and contraction. Potting 68 is relatively rigid to provide structural integrity to keypad 10 and to prevent ingress of moisture or other fluids into the inner region of housing 12 through rear opening 34.

To enable external electrical communication with keypad 10, a connector 70 is soldered onto the backside of circuit board 18 prior to assembly of the components into housing 12. As indicated in FIG. 3, connector 70 is dimensioned so as to extend rearward from circuit board 18 past rear opening 34 so that it will be securely held, but not completely encapsulated, by potting 68.

Figure 4:
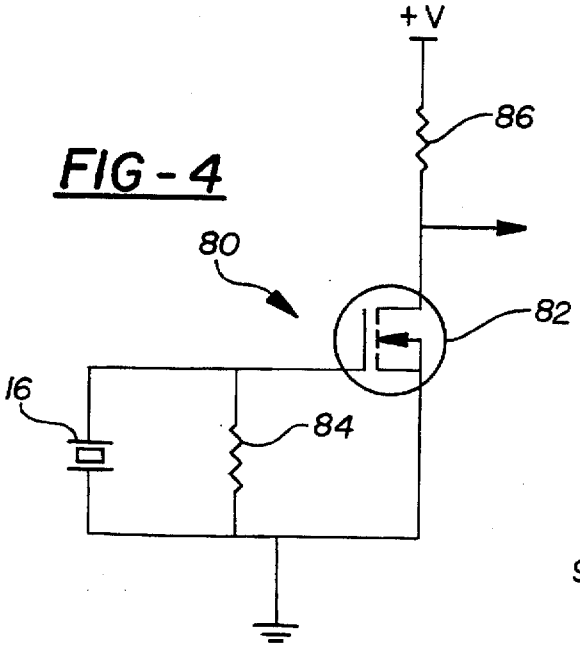
FIG. 4 is a schematic of one embodiment of a circuit for detecting activation of one of the transducers.
Figure 5:
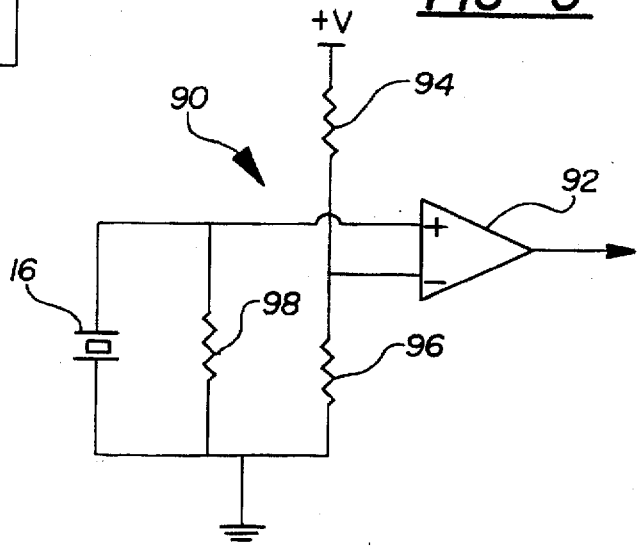
FIG. 5 is a schematic of a second embodiment of a circuit for detecting activation of one of the transducers.

FIG. 4 discloses a transducer circuit 80 for generating an output in response to activation of a piezoelectric transducer 16. As will be appreciated, circuit board 18 will contain one such circuit per transducer. Circuit 80 includes a MOSFET 82 having its gate connected to electrode **16*c* of transducer 16. The source of MOSFET 82 is connected to ground as is electrode 16*b* of transducer 16. The drain of MOSFET 82 is connected to an input of a conventional circuit (not shown) that generates industry standard outputs, such as Wiegand, BCD, X-Y matrix, and 2 of 7 output formats. Circuits for generating these standard outputs in response to the signals from the transducer circuits of FIGS. 4 and 5 are well known to those skilled in the art. Accordingly, the drain of MOSFET 82 is shown as the output of circuit 80. A pull-down resistor 84 is connected between the gate and source of MOSFET 82 to bias MOSFET 82 off in the absence of charge generated by transducer 16. A pull-up resistor 86 is connected between the drain of MOSFET 82 and a voltage source to bias the output of circuit 80 to a logic high level when MOSFET 82** is switched off.

In the absence of deformation of transducer 16, pull-down resistor 84 will maintain MOSFET 82 in a non-conductive state, with the output of circuit 80 being biased to a logic high level due to pull-up resistor 86. As is known, when transducer 16 is deformed, it develops a voltage across its terminals. When it is deformed enough to generate a voltage greater than the threshold voltage of MOSFET 82, the latter will turn on, forcing the output of circuit 80 to a logic low level.

FIG. 5 shows a circuit 90 that performs the same function as circuit 80 of FIG. 4, except that it provides an active high output, rather than the active low output of circuit 80. It utilizes a comparator 92 having its inverting input connected to receive a reference voltage set by a voltage divider formed from a pair of resistors 94 and 96 connected serially between the voltage supply and ground. The non-inverting input of comparator 92 is connected to electrode **16*c* of,transducer 16, with electrode 16*b* being connected to ground. A pull-down resistor 98 is also connected between the non-inverting input of comparator 92 and ground. The output of comparator 92 comprises the output of circuit 90**.

In the absence of voltage across piezoelectric transducer 16, pull-down resistor 98 maintains the voltage at the non-inverting input of comparator 92 below the reference voltage provided by resistors 94 and 96. Thus, the output of comparator 92 will be at a logic low level. When transducer 16 is deformed sufficiently to generate a voltage in excess of the reference voltage at the inverting input, the output of comparator 92 will swing to a logic high level.

If a force sensitive resistor is used as transducer 16, then circuits 80 and 90 would be modified slightly so that the force sensitive resistor is connected not to ground, but to the voltage supply line. This is done because the force sensitive resistor has a very large resistance in the absence of deformation, such that a negligible amount of current will flow through it and the circuits will remain biased off by their pull-down resistors. Then, when the force sensitive resistor is deformed, its resistance decreases dramatically allowing sufficient current to flow through the force sensitive resistor to drive the input voltage above the threshold voltage (in the case of MOSFET 82 of circuit 80) and the reference voltage (in the case of comparator 92 of circuit 90).

The disclosed embodiment is representative of a presently preferred embodiment of the invention, but is intended to be illustrative rather than definitive thereof. The invention is defined in the claims.

We claim:

1. An electronic keypad comprising:

a plastic housing that includes a generally planar front wall having an outside surface and an inside surface;

a plurality of transducers secured to said inside surface of said front wall;

an overlay covering at least a portion of said outside surface of said front wall, said overlay containing indicia each of which is associated with one of said transducers and being located on said overlay opposite its associated transducer to identify the location of said associated transducer, said overlay being removable to permit replacement of said overlay; and an electronic circuit electrically coupled to each of said transducers, said overlay and said front wall together having sufficient flexibility that said inside surface of said front wall is deformable upon application of finger pressure to said overlay, each of said transducers being deformable in response to localized deformation of said inside surface that results from the application of finger pressure to said overlay at a location opposite said transducer, each of said transducers having a characteristic that undergoes a measurable change in response to said localized deformation of said inside surface, whereby finger pressure can be applied to any one of said indicia on said overlay to cause a measurable change in characteristic of the one of said transducers associated with said one of said indicia, and said electronic circuit is operable in response to detect a measurable change in characteristic of said one of said transducers to generate an output that indicates the activation of said one of said transducers.

2. An electronic keypad as defined in claim 1 wherein said housing includes one or more side walls that support said front wall, said one or more side walls extending out of the plane defined by said front wall in a direction away from said outside surface, said inside surface of said front wall and said one or more side walls together defining an inner region of said housing and a rear opening for access into said inner region, said electronic circuit being mounted within said inner region in spaced relation to said transducers, said rear opening being sealed against the ingress of water and other fluids.

3. An electronic keypad as defined in claim 2 wherein said front wall and said one or more side walls comprise a unitary plastic molded housing, said electronic circuit is located on a printed circuit board mounted substantially parallel to said front wall within said inner region, and the electronic keypad further comprises a first layer of potting material located between said printed circuit board and said transducers and a second layer of potting material located between said printed circuit board and said rear opening, said first potting material being less rigid than said second potting material.

4. An electronic keypad as defined in claim 3 further comprising a double sided adhesive tape adhering said transducers to said inside surface, a flexible layer between said transducers and said first potting material, and an electrical connector located at said rear opening and secured in place by said second potting material.

5. An electronic keypad as defined in claim 1 further comprising at least one light source mounted proximate said indicia and being oriented relative to said indicia to transmit light that illuminates said indicia.

6. An electronic keypad as defined in claim 1 wherein said transducers comprise piezoelectric elements, whereby the characteristic of said transducers is voltage across he piezoelectric.

7. An electronic keypad as defined in claim 1 wherein said transducers comprise force sensitive resistors, whereby the characteristic of said transducers is resistance.

8. An electronic keypad comprising:

a) a plastic housing defined by a substantially planer front wall, side walls joined to said front wall, and sealing material substantially parallel to but spaced from said front wall and spanning said side walls to form with said front wall and said side walls a sealed cavity, said front wall having an outside surface and an inside surface;

b) a plurality of spaced apart transducers secured to the inside surface of said front wall;

c) an electronic circuit coupled to each of said transducers and accommodated in said cavity;

d) an overlay removably carried by said front wall on its outside surface and having a plurality of spaced apart indicia corresponding to the number and spacing of said transducers;

e) each of said transducers being deformable and having a characteristic which undergoes a measurable change in response to its being deformed;

f) said electronic circuit being operable in response to the measurable change in the characteristic of each of said transducers to generate an output indicative of the deformation of such transducers;

g) said overlay and said front wall together having sufficient flexibility to deform any selected one of said transducers in response to the application of finger pressure to said overlay at a corresponding one of said indicia; and h) said overlay being removable from said front wall to permit replacement thereof with a substitute, similar overlay and without requiring unsealing of said housing.

* * * * *